US007990280B2

(12) United States Patent
Gray

(10) Patent No.: US 7,990,280 B2
(45) Date of Patent: Aug. 2, 2011

(54) EXIT ALARM ESCUTCHEON

(75) Inventor: John Steven Gray, Maryville, TN (US)

(73) Assignee: Yale Security Inc., Monroe, NC (US)

( * ) Notice: Subject to any disclaimer, the term of this patent is extended or adjusted under 35 U.S.C. 154(b) by 153 days.

(21) Appl. No.: 11/738,100

(22) Filed: Apr. 20, 2007

(65) Prior Publication Data

US 2008/0258911 A1 Oct. 23, 2008

(51) Int. Cl.
*G08B 23/00* (2006.01)

(52) U.S. Cl. ..... 340/693.5; 340/540; 340/542; 340/541; 340/545.7

(58) Field of Classification Search ..... 340/540, 340/693.5, 542, 541.54, 545.1, 545.7, 541; 70/1, 432, 448
See application file for complete search history.

(56) References Cited

U.S. PATENT DOCUMENTS

| | | | | | |
|---|---|---|---|---|---|
| 315,152 | A | | 4/1885 | Leek | |
| 3,993,335 | A | * | 11/1976 | Schmidt | 292/21 |
| 4,006,471 | A | * | 2/1977 | Pappas | 340/542 |
| 4,101,153 | A | * | 7/1978 | Dozier | 292/92 |
| 4,196,422 | A | * | 4/1980 | Swigert et al. | 340/542 |
| 4,257,631 | A | * | 3/1981 | Logan, Jr. | 292/251.5 |
| 4,258,358 | A | * | 3/1981 | Lee et al. | 340/543 |
| 4,295,673 | A | * | 10/1981 | Miller | 292/21 |
| 4,305,612 | A | * | 12/1981 | Hunt et al. | 292/336.3 |
| 4,631,528 | A | * | 12/1986 | Handel et al. | 340/545.7 |
| 4,683,741 | A | * | 8/1987 | Fields | 70/432 |
| 4,760,380 | A | * | 7/1988 | Quenneville et al. | 340/542 |
| 4,769,010 | A | * | 9/1988 | Fenton et al. | 604/180 |
| 4,802,353 | A | * | 2/1989 | Corder et al. | 70/277 |
| 4,912,456 | A | * | 3/1990 | Mickel | 340/542 |
| 4,982,986 | A | * | 1/1991 | Gressett et al. | 292/336.3 |
| 4,983,947 | A | * | 1/1991 | Mullen et al. | 340/426.28 |
| 5,057,830 | A | * | 10/1991 | Eisermann | 340/5.3 |
| 5,062,670 | A | * | 11/1991 | Grossman | 292/137 |
| 5,158,172 | A | * | 10/1992 | Roeser et al. | 200/553 |
| 5,311,168 | A | * | 5/1994 | Pease et al. | 340/542 |
| 5,412,961 | A | * | 5/1995 | Cain et al. | 70/92 |
| 5,484,179 | A | * | 1/1996 | Mader | 292/336.3 |
| 5,490,698 | A | * | 2/1996 | Dezso | 292/138 |
| 5,539,378 | A | * | 7/1996 | Chang | 340/542 |
| 5,564,294 | A | * | 10/1996 | Chen | 70/1 |
| 5,658,026 | A | * | 8/1997 | Nigro et al. | 292/336.3 |
| 5,664,816 | A | * | 9/1997 | Nigro et al. | 292/336.3 |
| 5,686,890 | A | * | 11/1997 | Ko | 340/545.1 |
| 5,754,107 | A | * | 5/1998 | Ferrantelli | 340/542 |
| 5,783,995 | A | * | 7/1998 | Jackson | 340/545.7 |

(Continued)

*Primary Examiner* — George A Bugg
*Assistant Examiner* — Hoi C Lau
(74) *Attorney, Agent, or Firm* — Matthew W. Witsil; Michael G. Johnston; Moore & Van Allen PLLC

(57) ABSTRACT

An exit alarm system housed in an escutcheon for activating upon movement of an interior latch operator. The system is mounted to the interior side of a door with a latch assembly including an interior latch operator. The system may include an alarm, a trigger, and an electronic module. The trigger is responsive to movement of the interior latch operator. The electronic module may be electrically connected to a power source for providing an input signal to the alarm. Upon motion of the interior latch operator, the trigger may cause the electronic module to send an activating input signal to the alarm. The alarm may be a sound transducer. A switch may be provide to arm the system. A tamper switch may be provided to cause the electronic module to activate the alarm upon removal of the escutcheon. The system may be applied to retrofit an existing door.

33 Claims, 9 Drawing Sheets

U.S. PATENT DOCUMENTS 5,823,582 A * 10/1998 Frolov et al. ..... 292/92
5,832,758 A * 11/1998 White ..... 70/218
5,947,534 A * 9/1999 Zarzycki, Jr. ..... 292/92
5,988,708 A * 11/1999 Frolov et al. ..... 292/92
5,999,095 A * 12/1999 Earl et al. ..... 340/542
6,008,726 A * 12/1999 Hagen ..... 340/543
6,225,903 B1 * 5/2001 Soloway et al. ..... 340/542
6,420,970 B1 * 7/2002 Kampmann et al. ..... 340/541
6,568,230 B1 5/2003 Chen
6,598,439 B1 * 7/2003 Chen ..... 70/423
6,715,225 B1 * 4/2004 Frolov et al. ..... 40/570
6,784,784 B1 * 8/2004 Zehrung ..... 340/5.3
6,812,836 B2 * 11/2004 Soloway et al. ..... 340/542
6,970,084 B2 * 11/2005 Kwon ..... 340/542
7,044,510 B2 * 5/2006 Lin ..... 292/93
7,096,698 B2 * 8/2006 Walsh et al. ..... 70/472
7,158,029 B1 * 1/2007 Martyn ..... 340/545.7
7,204,050 B2 * 4/2007 Molokotos et al. ..... 40/570
7,249,477 B2 * 7/2007 Toloday et al. ..... 70/279.1
7,339,472 B2 * 3/2008 Pierson et al. ..... 340/542
2001/0042534 A1 * 11/2001 Brister ..... 123/198 D
2005/0156439 A1 * 7/2005 Furlong ..... 292/336.3
2005/0229657 A1 * 10/2005 Johansson et al. ..... 70/107
2006/0130822 A1 * 6/2006 Jong ..... 124/51.1
2007/0001816 A1 * 1/2007 Lindley et al. ..... 340/10.34
2007/0040674 A1 * 2/2007 Hsu ..... 340/539.31
2007/0222626 A1 * 9/2007 Picard et al. ..... 340/584
2010/0109352 A1 * 5/2010 Tien et al. ..... 292/336.3

* cited by examiner

EXIT ALARM ESCUTCHEON

BACKGROUND

This invention relates to the field of exit alarms for doors, and more particularly concerns concealment of an exit alarm assembly in an escutcheon.

Various types of exit alarms, which sound as a door is opened from the inside, have been used effectively as a means of egress control. Examples of the various types include standalone box alarms, paddle arms, exit devices with integrated alarms, delayed egress exit devices, and others. While allowing egress, the alarm function deters the use of an opening except under emergency situations such as a fire, natural disaster, or manmade crisis.

The type of alarm unit used depends on the type of occupancy for which the building was designed. When the opening is to be used for egress as part of life-safety codes, an exit device, such as a device with a crossbar or flatbar operator, or similar panic device may be used and could contain an integral alarm function. When the occupancy is low or the opening is not considered to be a path of egress for life-safety, other locks, for example, mortise or cylindrical locks, may be used. Current practice provides for use of such locks in conjunction with a box alarm that is mounted separately on the door and frame, although other more complicated solutions are available that require hardwiring to external power sources. The resulting opening is fully functional, but the box alarms are unsightly and require additional installation time. In addition, identifying sources for and correctly installing separate products takes a significant amount of coordination, cost, and effort.

Accordingly, there exists a need for an alarm that is aesthetically pleasing and housed in a single unit. Ideally, the alarm unit may be standalone or designed to be connected to an external power source.

SUMMARY

In accordance with an embodiment of the present invention, an exit alarm escutcheon system for a door latch assembly for a door is provided. The door has an interior side and the latch assembly includes an interior latch operator. A housing is adapted to be mounted to the interior side of the door, and an alarm and trigger are disposed within the housing. The trigger is adapted to be actuated by movement of the interior latch operator. Actuation of the trigger causes a signal to be sent to the alarm to put the alarm into operation.

In accordance with another embodiment of the present invention, an exit alarm escutcheon system for a door latch assembly for a door is provided. The door has an interior side and the latch assembly includes an interior latch operator. A housing is adapted to be mounted to the interior side of the door, and an alarm is disposed within the housing. A trigger is adapted to be disposed in the door and is adapted to be actuated by movement of the interior latch operator. Actuation of the trigger causes a signal to be sent to the alarm to put the alarm into operation.

In accordance with another embodiment of the present invention, an exit alarm escutcheon system for a door latch assembly for a door is provided. The door has an interior side and the latch assembly includes an interior latch operator. A housing is adapted to be mounted to the interior side of the door, and a sound transducer, electronic module, trigger, and toggle switch are disposed within the housing. The electronic module is for providing an input signal to the sound transducer. The trigger is adapted to be actuated by movement of the interior latch operator. Actuation of the trigger causes a signal to be sent to the sound transducer to put the sound transducer into operation. The toggle switch in a first position arms the system to be capable of putting the sound transducer into operation and in a second position disarms the system so that the system is incapable of putting the sound transducer into operation. The electronic module is electrically connected to and signals the toggle switch, such that in the first position the toggle switch signals back to the electronic module, and in the second position the toggle switch does not signal back to the electronic module. The movement of the interior latch operator causes the trigger to signal the electronic module, causing the electronic module to send an input signal to the sound transducer to put the sound transducer into operation.

In accordance with another embodiment according to the present invention, an exit alarm escutcheon system for a door latch assembly for a door is provided. The door has an interior side and the latch assembly includes an interior latch operator. The exit alarm escutcheon system includes means for arming the system, means for actuating a trigger, means for signaling an electronic module, and means for putting an alarm into operation.

In accordance with another embodiment according to the present invention, an interior-side alarmed exit door system includes a door having an interior side and including a latch assembly including an interior latch operator. A housing is adapted to be mounted to the interior side of the door, and an alarm and a trigger are disposed within the housing. The trigger is adapted to be actuated by movement of the interior latch operator. The actuation of the trigger causes a signal to be sent to the alarm to put the alarm into operation.

In accordance with another embodiment of the present invention, a method of operating an exit alarm escutcheon system is provided. The method includes arming the system, actuating a trigger, signaling an electronic module, and putting an alarm into operation.

In accordance with another embodiment of the present invention, a method of making an exit alarm escutcheon system for a door latch assembly is provided. The door has an interior side and the latch assembly includes an interior latch operator. The method includes providing a housing adapted to be mounted to the interior side of the door. An alarm, trigger, and electronic module are all provided and are disposed within the housing. The trigger is adapted to be responsive to movement of the interior latch operator. The electronic module is for providing an input signal to the alarm. The alarm and the trigger are electrically connected to the electronic module.

In accordance with another embodiment of the present invention, a method of making an exit alarm escutcheon system for a door latch assembly is provided. A door is provided and has an interior side and the latch assembly includes an interior latch operator. A housing is mounted to the interior side of the door, and an alarm and an electronic module are disposed within the housing. The electronic module is for providing an input signal to the alarm. A trigger is adapted to be responsive to movement of the interior latch operator, disposed within the housing. The alarm and the trigger are electrically connected to the electronic module.

Features and advantages of the present invention will become more apparent in light of the following detailed description of some embodiments thereof, as illustrated in the accompanying figures. As will be realized, the invention is capable of modifications in various respects, all without departing from the invention. Accordingly, the drawings and the description are to be regarded as illustrative in nature, and not as restrictive.

DESCRIPTION

Figure 1:
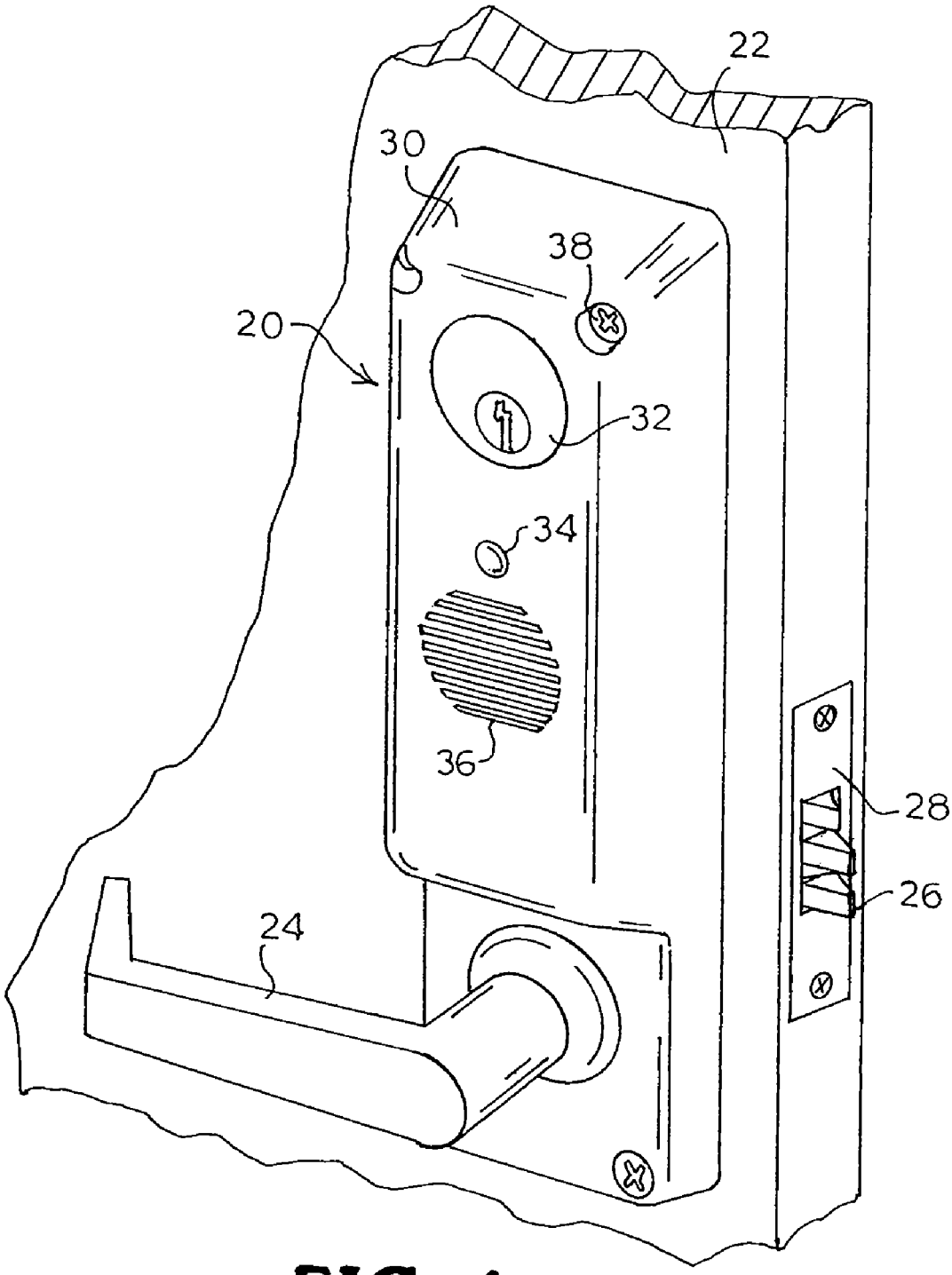
FIG. 1 is a perspective view of an embodiment of an exit alarm unit according to the present invention installed on a door and with a latch operating lever.

In the Figures herein, unique features receive unique reference numerals, while features that are the same in more than one drawing receive the same reference numerals throughout. Further, certain terms of orientation may be used, such as "upper," "lower," "top," "bottom," "left," "right," "inside," "outside," "interior," "exterior," "inner," and "outer." These terms are generally for convenience of reference, and should be so understood unless a particular embodiment requires otherwise.

The scope of the invention is not intended to be limited by materials listed herein, but may be carried out using any materials that allow the construction and operation of the present invention. Materials and dimensions depend on the particular application. In general the materials of the components may be metal, and selectively may be plastic, as known by one of ordinary skill in the art.

Referring now to the drawings, an embodiment of an exit alarm unit 20 according to the present invention is shown in FIG. 1. The exit alarm unit 20 is mounted to a door 22 and has a latch operator 24 passing therethrough and an associated latch assembly with a latch 26 and a cover plate 28. The operator 24 is shown as a lever, but could be a knob, handle, or the like. The exit alarm unit 20 maybe used with a variety of locks (not shown), including but not limited to mortise and cylindrical locks. Further, the exit alarm unit 20 may be used not only on a door for a new installation, but may be retrofitted to an existing door. For a retrofit application, the exit alarm unit 20 may be provided, for example, as a kit, and may allow a door with mechanical locking and latching to be changed to an alarmed opening for greater control and security, similarly to a new installation.

The exit alarm unit 20 includes an escutcheon comprising a housing 30, a keyed actuator or cylinder 32, an indicator 34, and a louver 36 to allow passage of sound. The housing 30 may be, for example, ABS plastic. The indicator 34 may be a light source such as a light emitting diode (LED) or a standard lamp. Screws 38 at each corner of the housing 30 secure the unit 20 to the door 22.

Figure 2:
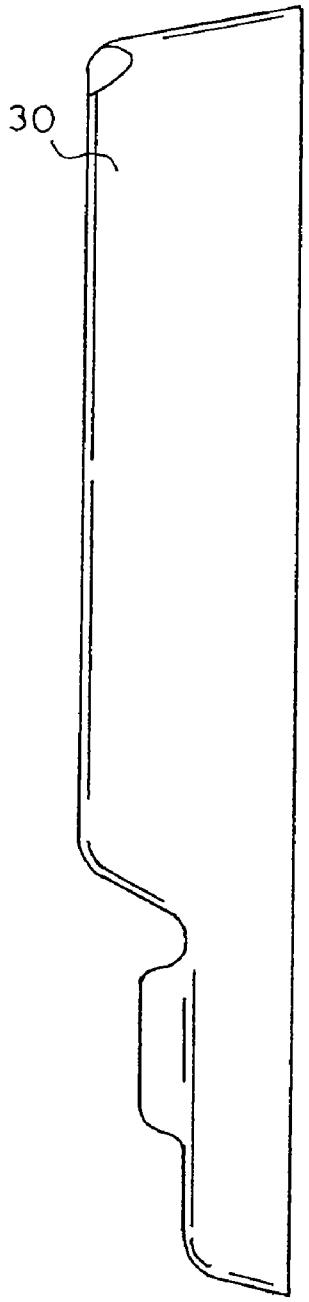
FIG. 2 is a side elevation view of an escutcheon of the exit alarm unit of FIG. 1.
Figure 3:
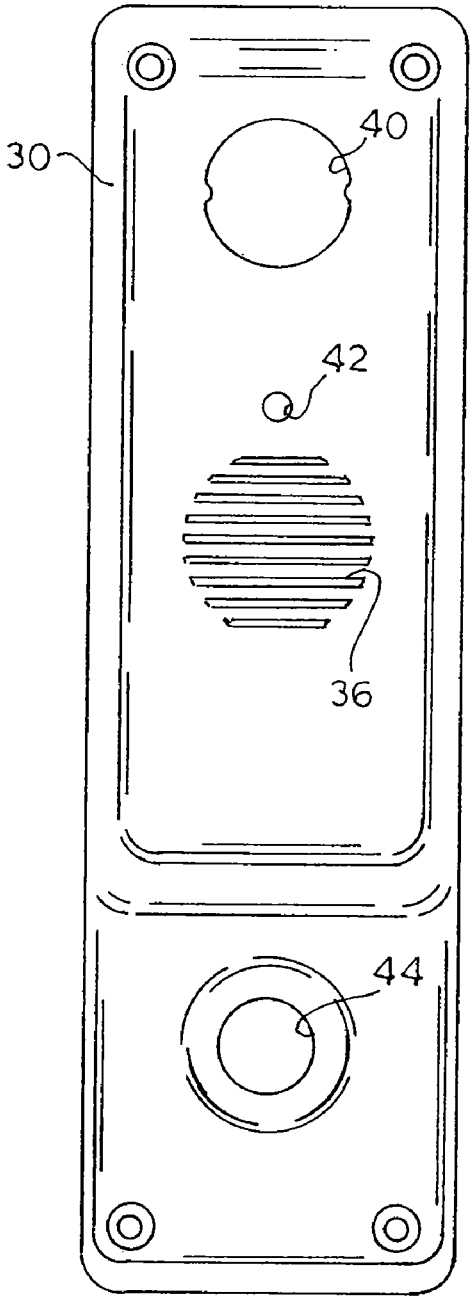
FIG. 3 is a front elevation view of the escutcheon of FIG. 2.

FIGS. 2 and 3 show the housing 30 of the escutcheon. The housing 30 has a keyed actuator opening 40, an indicator opening 42, a spindle opening 44, and the louver 36. The thickness of the housing 30 increases in the portion above the spindle opening 44 to accommodate internal components.

Figure 4:
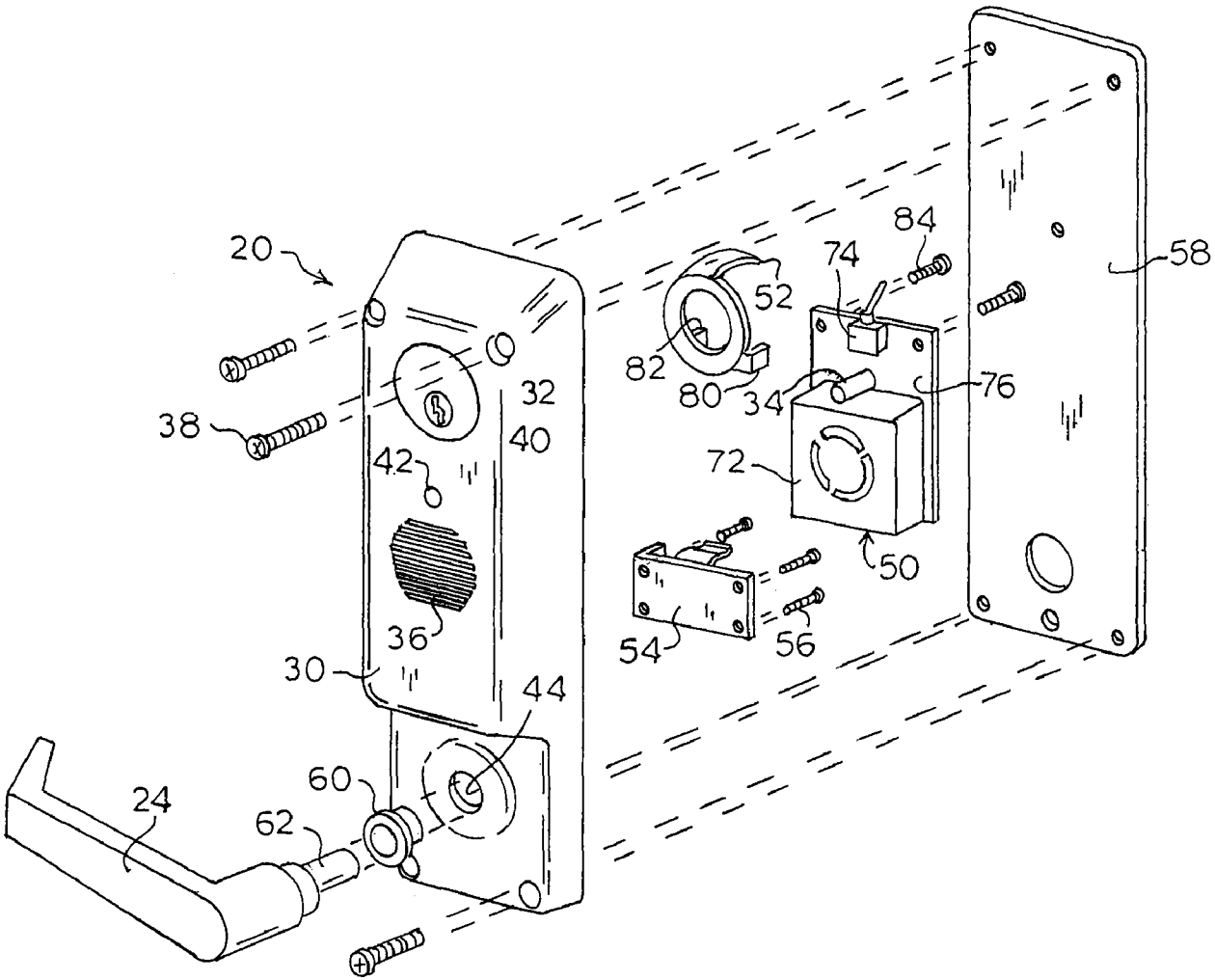
FIG. 4 is a partially exploded front perspective view of the exit alarm unit and latch operating lever of FIG. 1.
Figure 5:
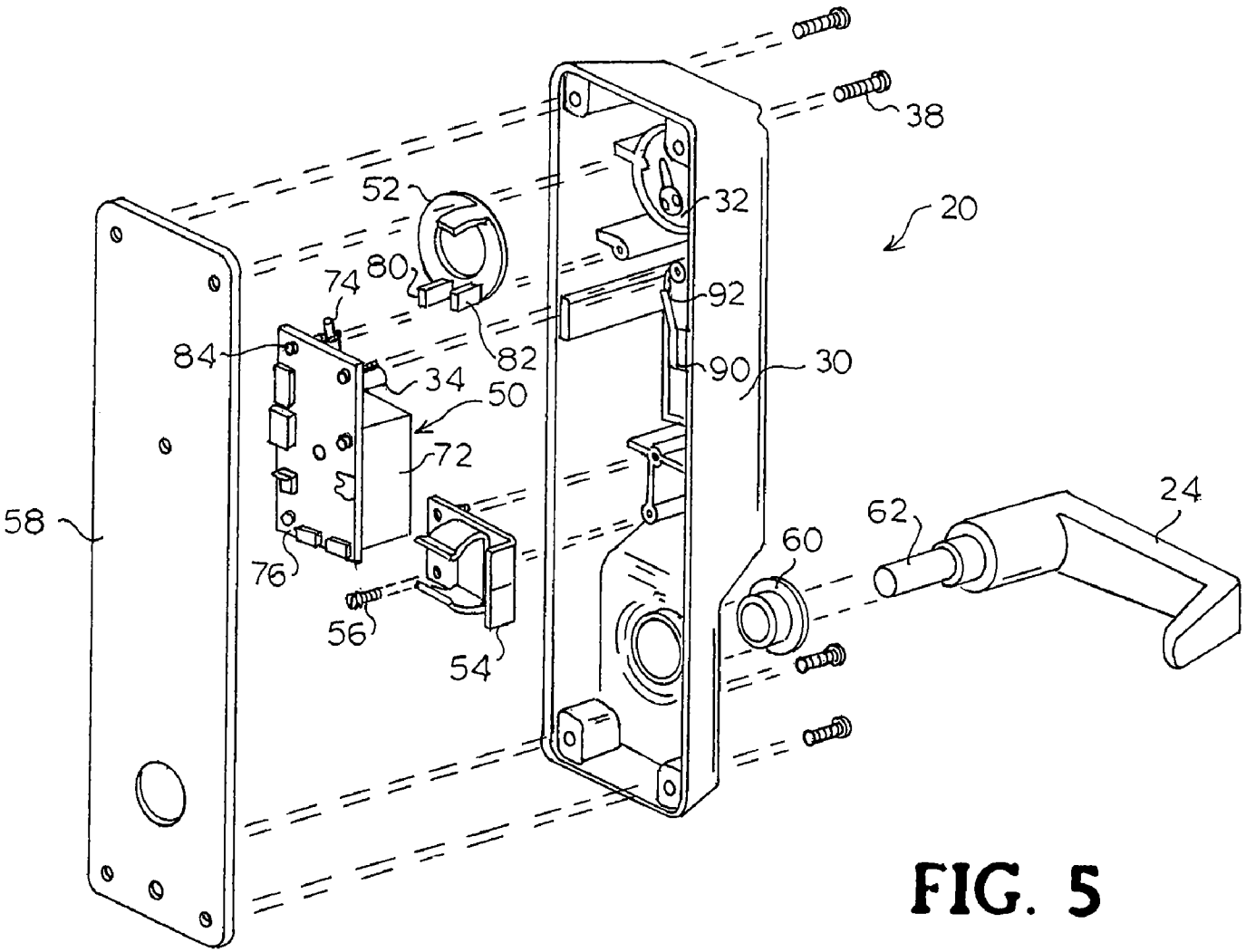
FIG. 5 is a partially exploded rear perspective view of the exit alarm unit and latch operating lever of FIG. 1.
Figure 6:
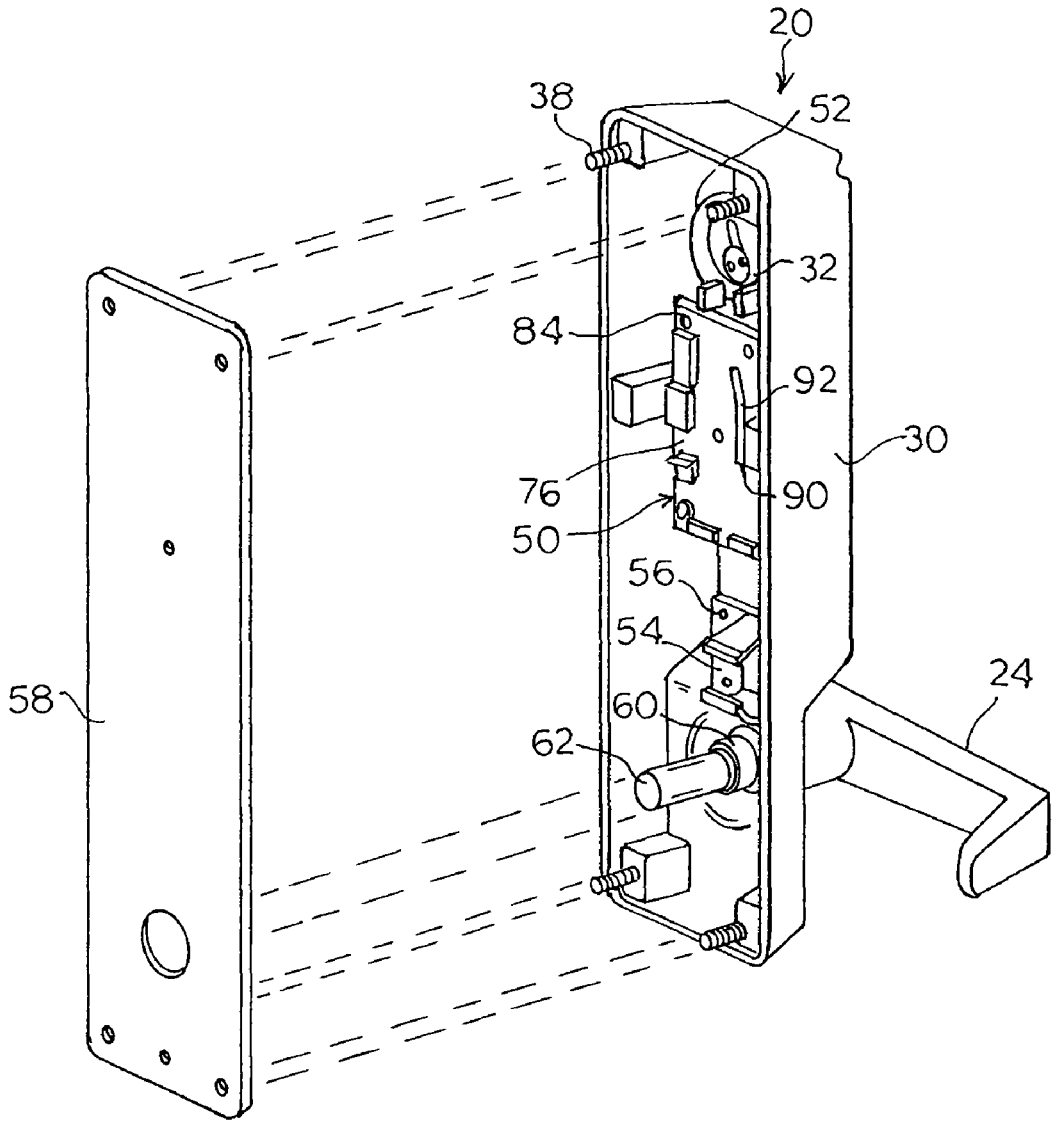
FIG. 6 is a partially exploded rear perspective view of the exit alarm unit and latch operating lever of FIG. 1.

Components internal to the housing 30 include an alarm assembly 50, an activation ring 52, and a battery holder 54, as shown in FIGS. 4-6. The battery holder 54 may be fastened to the housing 30 with screws 56 or omitted and replaced with hardwiring to an external power source. A plate 58 may be interposed between the housing 30 and the door 22. A bearing 60 may be mounted within the spindle opening 44 for journaling a smaller diameter portion of the latch operator 24 within the casing of the housing 30. A spindle 62 integral with the lever 24 extends into the housing for operating the latch 26, as is conventional. The alarm assembly 50 includes an alarm 72, an arm/disarm switch 74, the lamp/LED or indicator 34, and an electronic module 76 to which the other components are mounted. The alarm 72 may be a sound transducer 72. Alternatively, the alarm 72 may take other forms, such as a light source or a generator 77 of a wireless signal 78 to be received at a location 79 external to the housing 30, such as at a remote location. The alarm assembly 50 may be fastened to the housing 30 with screws 84.

Electrical components of the escutcheon may signal each other by either sending a signal when a lack of a signal is the default condition, or by stopping to send a signal when the presence of a signal is the default condition. For example, a switch that is open in the default condition, making the circuit open, may close to send a signal to another component, thereby signaling that component. A switch that is closed in the default condition, making the circuit closed, may open to stop sending a signal to another component, thereby signaling that component.

The arm/disarm switch 74 may be a toggle switch, as shown in the Figures, or another type of switch as selected by one of ordinary skill in the art. As will be described below, the prongs 80, 82 on the activation ring 52 may be adapted to toggle the arm/disarm switch 74 upon rotation of the activation ring 52.

The electronic module 76 can be or can include (1) a circuit board having a single, custom integrated circuit and supporting components mounted thereon, (2) multiple interconnected discrete components or integrated circuits, or (3) a combination of multiple discrete components and multiple integrated circuits mounted thereon. Electrical wiring is omitted from the figures for clarity.

A trigger switch (not shown) is provided that detects movement of the latch operator 24. The trigger switch may be selected as known by one of ordinary skill in the art and is conventional, for example, a microswitch, and may be located in a lockbody case in the door 22 or within the housing 30 adjacent the operator 24. Detection of movement of the spindle 62 may, for example, be through the use of a cam on the spindle that then engages the switch. The trigger switch closes to trigger the alarm when the operator 24 is moved or rotated to open the door 22.

A tamper switch 90 may also be provided in the housing 30. The tamper switch 90 includes an arm 92 that is biased against the plate 58 when the housing 30 is mounted to the door 22. When the unit 20 is armed, the removal of the unit 20 from the door 22 actuates the tamper switch 90 as the arm 92 is no longer biased against the plate 58, activating the sound transducer 72.

Figure 7:
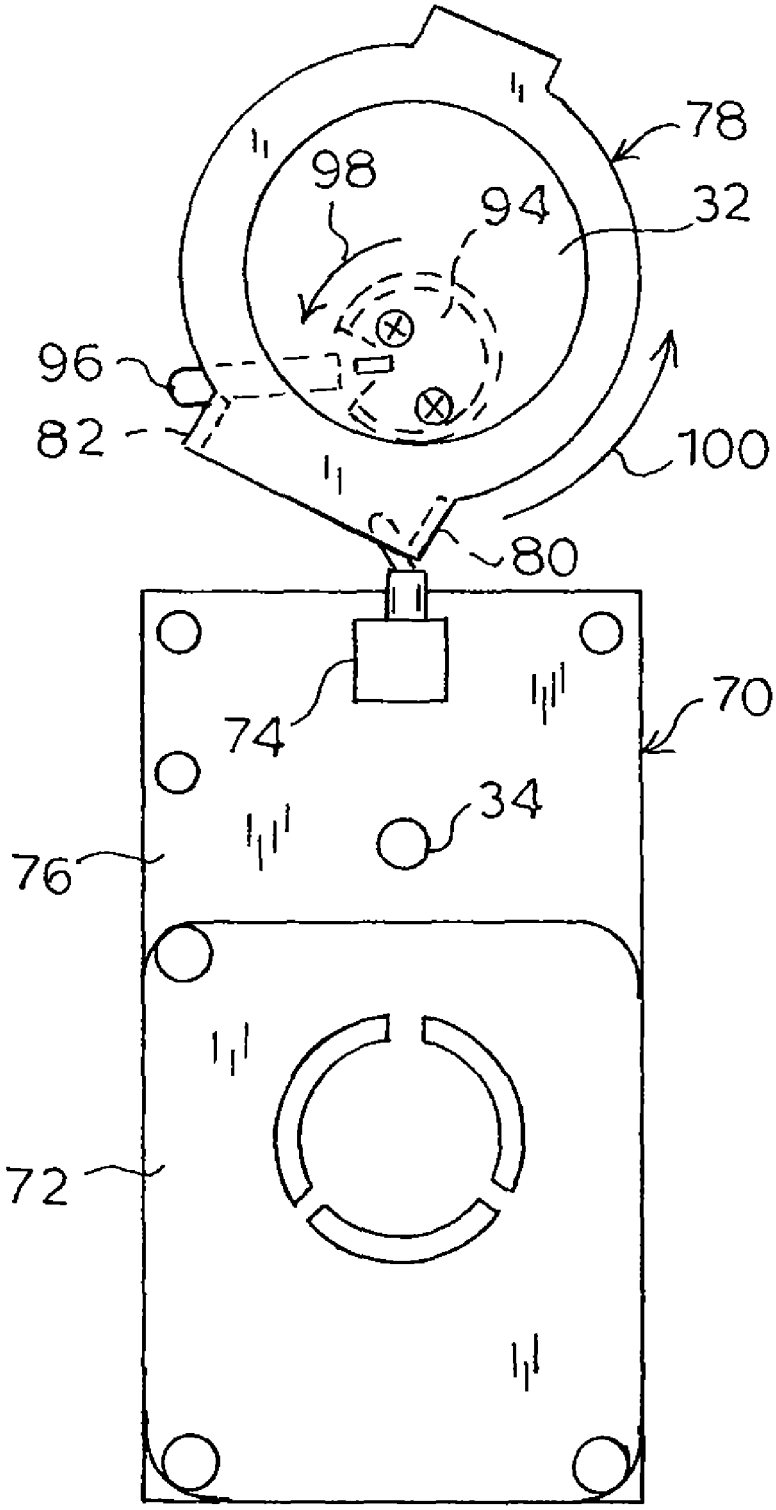
FIG. 7 is a front elevation view of the arming mechanism of the exit alarm unit of FIG. 1.

FIG. 7 shows the alarm assembly 70, the activation ring 52, and the keyed actuator 32 arranged as in the housing 30. The unit 20 is armed and disarmed by moving the arm/disarm switch 74 between the on and off positions by rotation of the activation ring 52, which is caused to rotate by the keyed actuator 32. Specifically, the keyed actuator 32 has a rotatable offset portion 94 that extends into the housing 30. An arm 96 integral with the offset portion 94 extends transversely to the axis of rotation of the offset portion 94. As shown in FIG. 7, the switch 74 is toggled to the left, and the right prong 80 of the activation ring 52 is in contact with the switch 74. To toggle the switch 74 to the right, a key (not shown) is inserted into the keyway in the keyed actuator 32. The offset portion 94 of the keyed actuator 32 is rotated 98 counterclockwise with the key, with the keyed actuator arm 96 causing the activation ring 52 to rotate 100 as well until the left prong 82 contacts the switch 74, pushing it to the right position. Alternative ways of actuating the switch 74 and alternative types of switches may be used as known by one of ordinary skill in the art. In addition, alternative ways of providing a secure method of control of the actuating mechanism may be used. For example, instead of being key-actuated, the arm/disarm switch may be a keypad-actuated switch that closes in order to arm the system when the appropriate code is entered.

Figure 8:
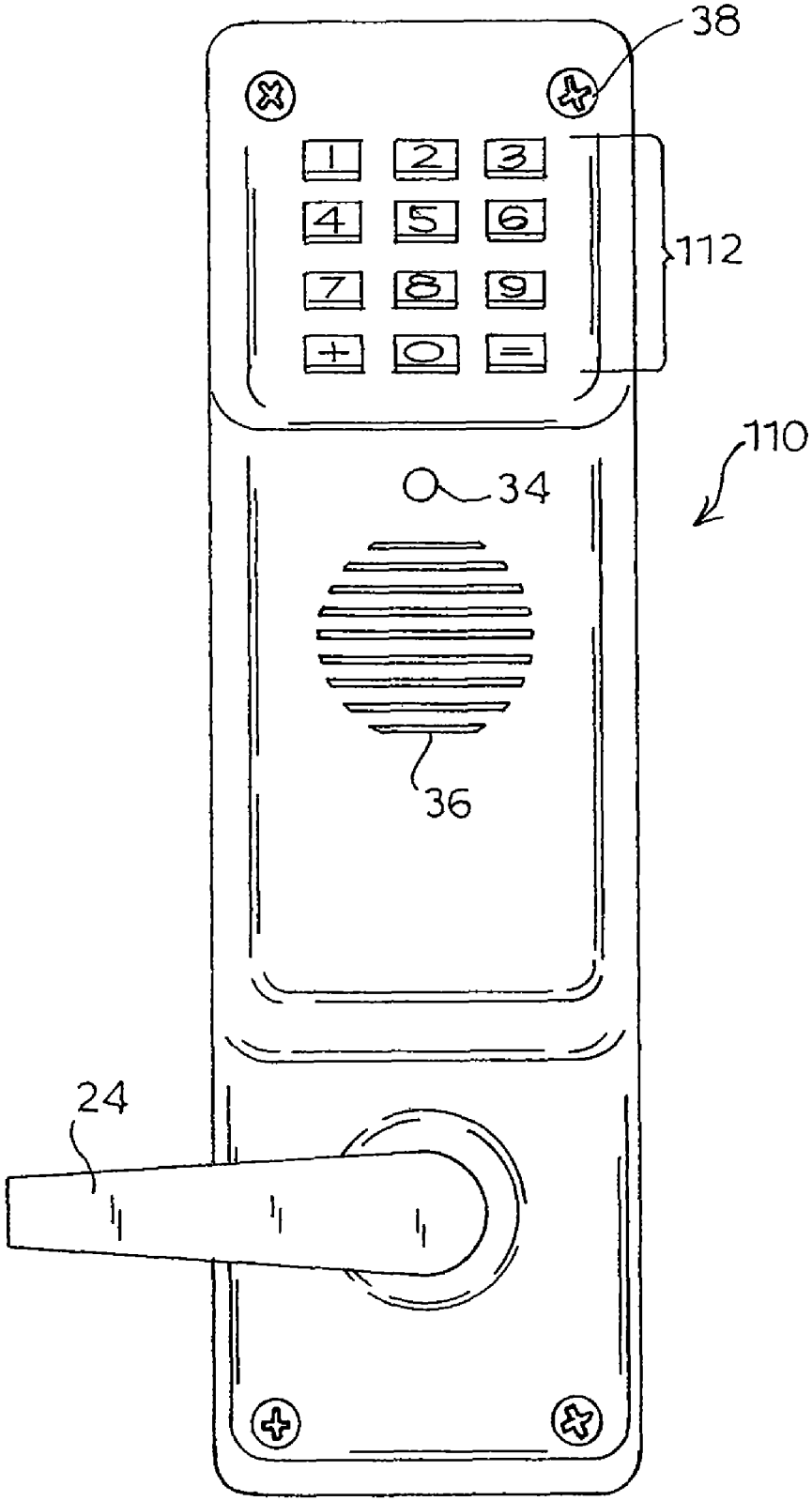
FIG. 8 is a front elevation view of another embodiment of an exit alarm unit according to the present invention.
Figure 9:
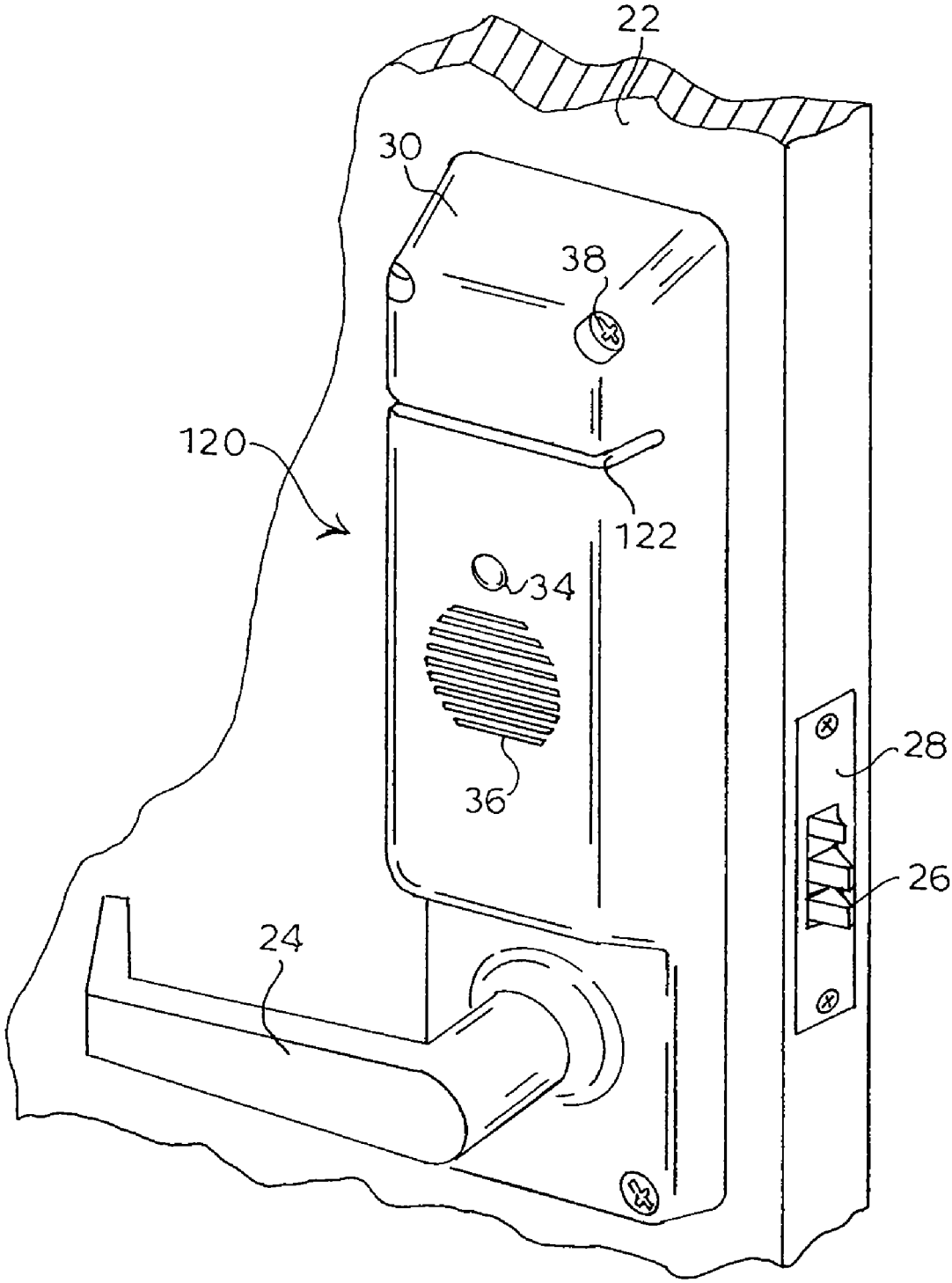
FIG. 9 is a front elevation view of yet another embodiment of an exit alarm unit according to the present invention.

FIGS. 8 and 9 show alternative embodiments of exit alarm units. The exit alarm unit 110 of FIG. 8 includes a keypad 112 to actuate an arm/disarm switch. The exit alarm unit 120 of FIG. 9 includes a magnetic reader device such as a card-swipe device 122 or smart card device for the same purpose.

Figure 10:
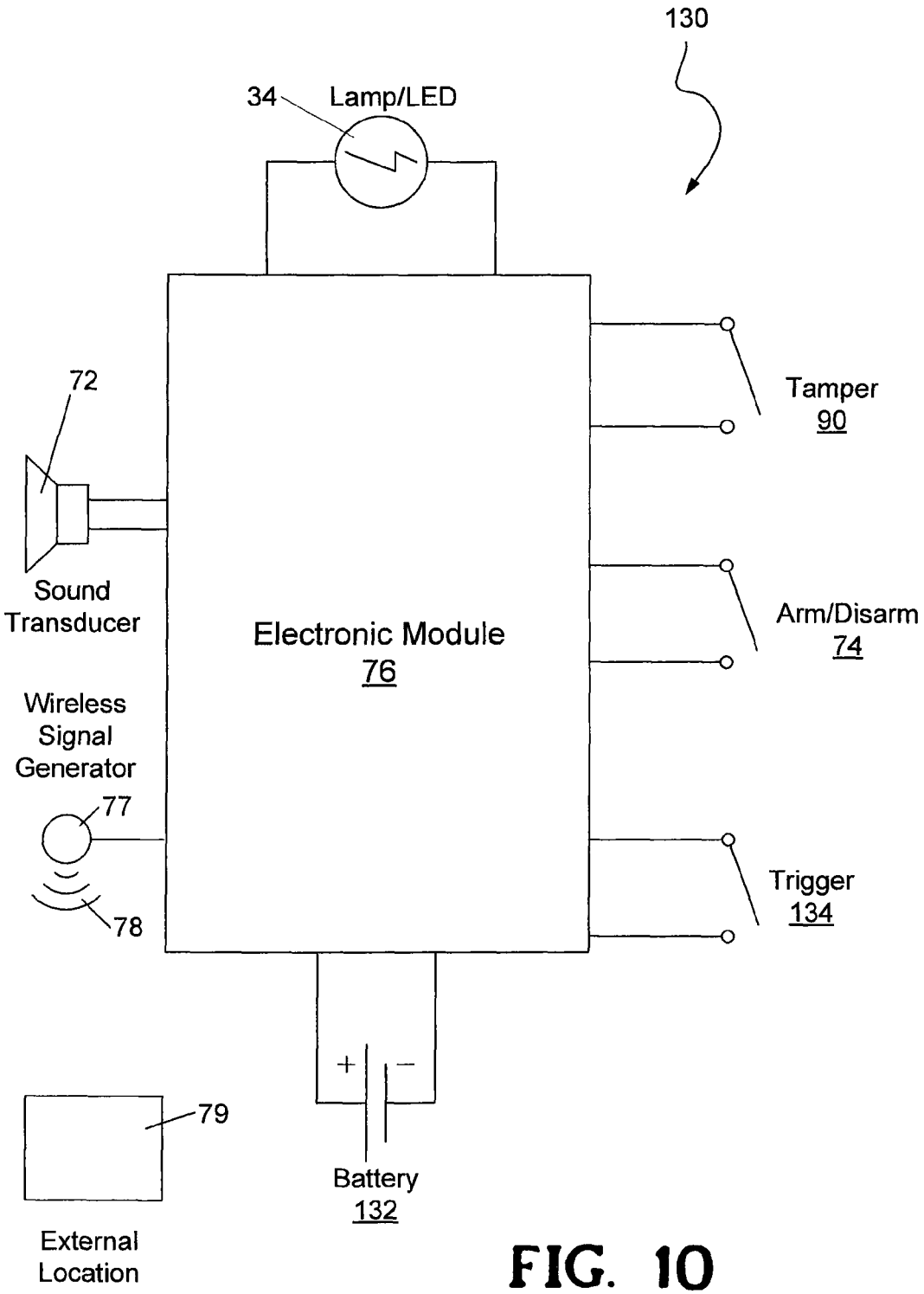
FIG. 10 is a schematic diagram showing the electrical elements of the exit alarm unit of FIG. 1.

FIG. 10 is a diagram of circuitry 130 that enables the alarm system to function. In example embodiments this circuitry can be at least partially located in the housing 30. The electronic logic required is straightforward and well within the design capabilities of an engineer or technician of ordinary skill in the electronic arts.

The electronic module 76 drives the indicator 34 and the sound transducer 72 to produce the appropriate visual and/or audible signals. The electronic module 76 obtains power from the battery 132. It should again be noted that a power source other than a battery could be used, and that power may be supplied by external means. The indicator 34 could be made to flash at different rates by appropriate logic contained in the electronic module 76, for example, flashing 30 milliseconds when the unit 20 is first armed and then once every 30 seconds. The output states of the indicator 34 and sound transducer 72 are determined by logic in the electronic module 76 according to the states of the tamper switch 90, arm/disarm switch 74, and alarm trigger switch 134. Assuming the logic of the electronic module 76 is designed to work with normally open switches, the tamper switch 90 is designed to close when the housing is opened or otherwise moved or damaged, the arm/disarm switch 74 is designated to close when the unit 20 is armed, and the trigger switch 134 is designed to close when the interior latch operator 24 is rotated.

It should be noted that either normally open or normally closed switches of various kinds could be used in the design described above. Also, there could be multiple switches for any of these functions. For example, if the enclosure of the lock system was such that two tamper switches would be needed, normally open switches connected in parallel or normally closed switches connected in series could be used. With some logic designs, one or more switches may need to be of the multiple pole and/or multiple throw type. The design options for circuitry 130 of FIG. 10 are almost endless, and FIG. 10 is intended to present but one example only.

Specific embodiments of an invention are described herein. One of ordinary skill in the lock and security hardware arts will recognize that the invention has other applications in other environments. In fact, many embodiments and implementations are possible. For example, the escutcheon of the present invention may be made in different shapes and sizes. The exit alarm unit may be configured to be used in other applications, such as windows. In addition, the recitation "means for" is intended to evoke a means-plus-function reading of an element in a claim, whereas, any elements that do not specifically use the recitation "means for," are not intended to be read as means-plus-function elements, even if they otherwise include the word "means." The following claims are in no way intended to limit the scope of the invention to the specific embodiments described.

What is claimed is:

1. An exit alarm escutcheon system for a door latch assembly for a door, the door having an interior side, the latch assembly including an interior latch operator and an associated spindle operatively connected to a latch, the exit alarm escutcheon system comprising:

a housing of unitary construction having a substantially open side adapted to be mounted to the interior side of the door without extending into the door, wherein the housing has an interior, and wherein the housing and a plane across the substantially open side of the housing define a volume that is the interior of the housing;

an alarm disposed within the interior of the housing; and a trigger disposed within the interior of the housing and adapted to be actuated by movement of the interior latch operator and the associated spindle, and not by movement of an exterior latch operator or a lock, regardless of whether the exterior latch operator is locked, wherein actuation of the trigger causes a signal to be sent to the alarm to put the alarm into operation.

2. The exit alarm escutcheon system of claim 1, further comprising an electronic module disposed within the interior of the housing for providing an input signal to the alarm, wherein the trigger signals the electronic module upon movement of the interior latch operator and the associated spindle, causing the electronic module to send the input signal to the alarm to put the alarm into operation.

3. The exit alarm escutcheon system of claim 2, further comprising a switch disposed in the interior of the housing that in a first position arms the system to be capable of putting the alarm into operation and in a second position disarms the system so that the system is incapable of putting the alarm into operation, wherein the electronic module is electrically connected to and signals the switch, such that in the first position the switch signals back to the electronic module, and in the second position the switch does not signal back to the electronic module.

4. The exit alarm escutcheon system of claim 3, further comprising a keyed actuator, wherein the switch is moved between first and second positions by the keyed actuator.

5. The exit alarm escutcheon system of claim 3, further comprising a keypad activated actuator, wherein the switch is moved between first and second positions by the keypad activated actuator.

6. The exit alarm escutcheon system of claim 3, further comprising a magnetic reader actuated actuator, wherein the switch is moved between first and second positions by the magnetic reader actuated actuator.

7. The exit alarm escutcheon system of claim 3, wherein the switch is a toggle switch.

8. The exit alarm escutcheon system of claim 7, further comprising a keyed actuator and a pronged ring that is rotated by the keyed actuator, wherein the pronged ring moves the toggle switch between first and second positions.

9. The exit alarm escutcheon system of claim 3, further comprising an indicator that is put into operation when the system is armed.

10. The exit alarm escutcheon system of claim 9, wherein the indicator comprises a lamp or light emitting diode that lights or flashes when put into operation.

11. The exit alarm escutcheon system of claim 9, wherein the indicator comprises a sound transducer that sounds when put into operation.

12. The exit alarm escutcheon system of claim 11, wherein the sound transducer generates an audible chirp when put into operation.

13. The exit alarm escutcheon system of claim 1, wherein the alarm comprises a sound transducer that sounds when put into operation.

14. The exit alarm escutcheon system of claim 1, wherein the alarm emits light when put into operation.

15. The exit alarm escutcheon system of claim 1, wherein the alarm generates a wireless signal receivable at a location outside of the housing when put into operation.

16. The exit alarm escutcheon system of claim 1, wherein the trigger comprises a microswitch.

17. The exit alarm escutcheon system of claim 1, further comprising a tamper switch disposed in the interior of the housing and adapted to be responsive to removal of the housing from the door, wherein the tamper switch signals the alarm to put the alarm into operation upon removal of the housing from the door.

18. The exit alarm escutcheon system of claim 1, further comprising an electrical connection for a power source external to the housing.

19. The exit alarm escutcheon system of claim 1, further comprising a power source disposed within the housing, including at least one battery.

20. An exit alarm escutcheon system for a door latch assembly for a door, the door having an interior side, the latch assembly including an interior latch operator and an associated spindle operatively connected to a latch, the exit alarm escutcheon system comprising:

a housing of unitary construction having a substantially open side adapted to be mounted to the interior side of the door without extending into the door, wherein the housing has an interior, and wherein the housing and a plane across the substantially open side of the housing define a volume that is the interior of the housing;

an alarm disposed within the interior of the housing; and a trigger adapted to be disposed within the door outside of the housing and adapted to be actuated by movement of the interior latch operator and the associated spindle, and not by movement of an exterior latch operator or a lock, regardless of whether the exterior latch operator is locked, wherein actuation of the trigger causes a signal to be sent to the alarm to put the alarm into operation.

21. The exit alarm escutcheon system of claim 20, further comprising an electronic module disposed within the interior of the housing for providing an input signal to the alarm, wherein the trigger signals the electronic module upon movement of the interior latch operator and the associated spindle, causing the electronic module to send the input signal to the alarm to put the alarm into operation.

22. The exit alarm escutcheon system of claim 21, further comprising a switch that in a first position arms the system to be capable of putting the alarm into operation and in a second position disarms the system so that the system is incapable of putting the alarm into operation, wherein the electronic module is electrically connected to and signals the switch, such that in the first position the switch signals back to the electronic module, and in the second position the switch does not signal back to the electronic module.

23. The exit alarm escutcheon system of claim 20, further comprising a tamper switch disposed in the interior of the housing and adapted to be responsive to removal of the housing from the door, wherein the tamper switch signals the alarm to put the alarm into operation upon removal of the housing from the door.

24. An exit alarm escutcheon system for a door latch assembly for a door, the door having an interior side, the latch assembly including an interior latch operator and an associated spindle operatively connected to a latch, the exit alarm escutcheon system comprising:

a housing of unitary construction having a substantially open side adapted to be mounted to the interior side of the door without extending into the door, wherein the housing has an interior, and wherein the housing and a plane across the substantially open side of the housing define a volume that is the interior of the housing;

a sound transducer disposed within the interior of the housing;

an electronic module disposed within the interior of the housing for providing an input signal to the sound transducer;

a trigger disposed within the interior of the housing and adapted to be actuated by movement of the interior latch operator and the associated spindle, and not by movement of an exterior latch operator or a lock, regardless of whether the exterior latch operator is locked; and a toggle switch disposed in the interior of the housing that in a first position arms the system to be capable of putting the sound transducer into operation and in a second position disarms the system so that the system is incapable of putting the sound transducer into operation, wherein the electronic module is electrically connected to and receives signals from the toggle switch, such that in the first position the toggle switch signals back to the electronic module, and in the second position the toggle switch does not signal back to the electronic module;

wherein the movement of the interior latch operator causes the trigger to signal the electronic module, causing the electronic module to send the input signal to the sound transducer to put the sound transducer into operation.

25. The exit alarm escutcheon system of claim 24, further comprising a tamper switch disposed in the interior of the housing and adapted to be responsive to removal of the housing from the door, wherein the tamper switch signals the alarm to put the alarm into operation upon removal of the housing from the door.

26. An interior-side alarmed exit door system comprising:

a door having an interior side with an interior surface and including a latch assembly including an interior latch operator and an associated spindle operatively connected to a latch;

a housing of unitary construction having a substantially open side mounted to the interior side of the door, wherein the housing has an interior, and wherein the housing and a plane across the substantially open side of the housing coincident with the interior surface of the door define a volume that is the interior of the housing;

an alarm disposed within the interior of the housing; and a trigger disposed within the interior of the housing and actuated by movement of the interior latch operator and the associated spindle, and not by movement of an exterior latch operator or a lock, regardless of whether the exterior latch operator is locked, wherein actuation of the trigger causes a signal to be sent to the alarm to put the alarm into operation.

27. The interior-side alarmed exit door system of claim 26, further comprising an electronic module disposed within the interior of the housing for providing an input signal to the alarm, wherein the movement of the interior latch operator and the associated spindle causes the trigger to signal the electronic module, causing the electronic module to send the input signal to the alarm to put the alarm into operation.

28. The interior-side alarmed exit door system of claim 27, further comprising a switch that in a first position arms the system to be capable of putting the alarm into operation and in a second position disarms the system so that the system is incapable of putting the alarm into operation, wherein the electronic module is electrically connected to and receives signals from the switch, such that in the first position the switch signals back to the electronic module, and in the second position the switch does not signal back to the electronic module.

29. A method of making an exit alarm escutcheon system for a door latch assembly, the door having an interior side, the latch assembly including an interior latch operator and an associated spindle operatively connected to a latch, the method comprising:

providing a housing of unitary construction having a substantially open side adapted to be mounted to the interior side of the door without extending into the door, wherein the housing has an interior, and wherein the housing and a plane across the substantially open side of the housing define a volume that is the interior of the housing;

providing an alarm disposed within the interior of the housing;

providing a trigger adapted to be responsive to movement of the interior latch operator and the associated spindle, and not to movement of an exterior latch operator or a lock, regardless of whether the exterior latch operator is locked, disposed within the interior of the housing;

providing an electronic module disposed within the interior of the housing for providing an input signal to the alarm; and electrically connecting the alarm and the trigger to the electronic module.

30. A method of installing an exit alarm escutcheon system, the method comprising:

providing a door having an interior side with an interior surface and including a latch assembly including an interior latch operator and an associated spindle operatively connected to a latch;

mounting a housing of unitary construction to the interior side of the door, the housing having a substantially open side mounted to the interior side of the door, wherein the housing has an interior, and wherein the housing and a plane across the substantially open side of the housing coincident with the interior surface of the door define a volume that is the interior of the housing, wherein an alarm and an electronic module are disposed within the interior of the housing, the electronic module for providing an input signal to the alarm;

providing a trigger responsive to movement of the interior latch operator and the associated spindle, and not to movement of an exterior latch operator or a lock, regardless of whether the exterior latch operator is locked, disposed within the interior of the housing; and electrically connecting the alarm and the trigger to the electronic module.

31. The method of claim 30, wherein the door is an existing door including mechanical locking and latching, and further comprising:

removing an existing latch operator;

removing an existing escutcheon or plate; and replacing the existing escutcheon or plate with the housing, wherein the remainder of the latch assembly is left in place.

32. An exit alarm escutcheon system for a door latch assembly for a door, the door having an interior side, the latch assembly including an interior latch operator and an associated spindle operatively connected to a latch, the exit alarm escutcheon system comprising:

a housing of unitary construction having a substantially open side adapted to be mounted to the interior side of the door, wherein the housing has an interior, and wherein the housing and a plane across the substantially open side of the housing define a volume that is the interior of the housing;

an alarm disposed within the interior of the housing;

a trigger disposed within the interior of the housing and adapted to be actuated by movement of the interior latch operator and the associated spindle, and not by movement of an exterior latch operator or a lock, regardless of whether the exterior latch operator is locked;

an electronic module disposed within the interior of the housing for providing an input signal to the alarm, wherein the trigger is adapted to signal the electronic module upon movement of the interior latch operator and the associated spindle, causing the electronic module to send the input signal to the alarm to put the alarm into operation;

a toggle switch disposed in the interior of the housing that in a first position arms the system to be capable of putting the alarm into operation and in a second position disarms the system so that the system is incapable of putting the alarm into operation, wherein the electronic module is electrically connected to and signals the switch, such that in the first position the toggle switch signals back to the electronic module, and in the second position the toggle switch does not signal back to the electronic module; and a keyed actuator and a pronged ring that is rotated by the keyed actuator, wherein the pronged ring moves the toggle switch between first and second positions.

33. The exit alarm escutcheon of claim 1, wherein all components of the exit alarm escutcheon system are within the housing or in contact with the housing.

* * * * *